United States Patent [19]

Keenan

[11] Patent Number: 4,461,442

[45] Date of Patent: Jul. 24, 1984

[54] HOLSTER HOLDER FOR BED

[76] Inventor: E. Dale Keenan, 12909 Old Marlboro Pk., Upper Marlboro, Md. 20870

[21] Appl. No.: 428,583

[22] Filed: Sep. 30, 1982

[51] Int. Cl.[3] ..... A47F 7/00

[52] U.S. Cl. ..... 248/205.1; 5/503; 5/508; 224/273; 248/95

[58] Field of Search ..... 248/205.1, 205.2, 213.2, 248/213.3, 213.4, 213.6, 544, DIG. 6, 300, 309 R; 224/193, 273, 42.45, 911, 912; 5/503, 508; 211/64

[56] References Cited

U.S. PATENT DOCUMENTS

| | | | |
|---|---|---|---|
| 1,579,552 | 4/1926 | Ludlow | 224/912 X |
| 1,842,786 | 1/1932 | Kirsch | 248/300 X |
| 1,964,035 | 6/1934 | Cross | 224/273 |
| 1,969,258 | 8/1934 | Cross | 224/273 |
| 2,557,674 | 6/1951 | McRae | 248/95 |
| 3,298,648 | 1/1967 | Sepanski | 5/503 X |
| 4,141,524 | 2/1979 | Corvese | 5/503 X |

FOREIGN PATENT DOCUMENTS

| | | | |
|---|---|---|---|
| 847661 | 7/1970 | Canada | 248/300 |

*Primary Examiner*—Ramon S. Britts
*Assistant Examiner*—Sarah A. Lechok
*Attorney, Agent, or Firm*—John B. Dickman, III

[57] ABSTRACT

A pistol holster bracket for supporting a pistol in its holster on the side of a bed is disclosed. The holster bracket has a member which slides between the mattress and a box spring and an upstanding vertical member with an angled element for receiving the belt loop of a holster. The angled element has an angle of sufficient decree to tilt the holster to a position where the pistol is easily accessible by a person lying in bed.

1 Claim, 4 Drawing Figures

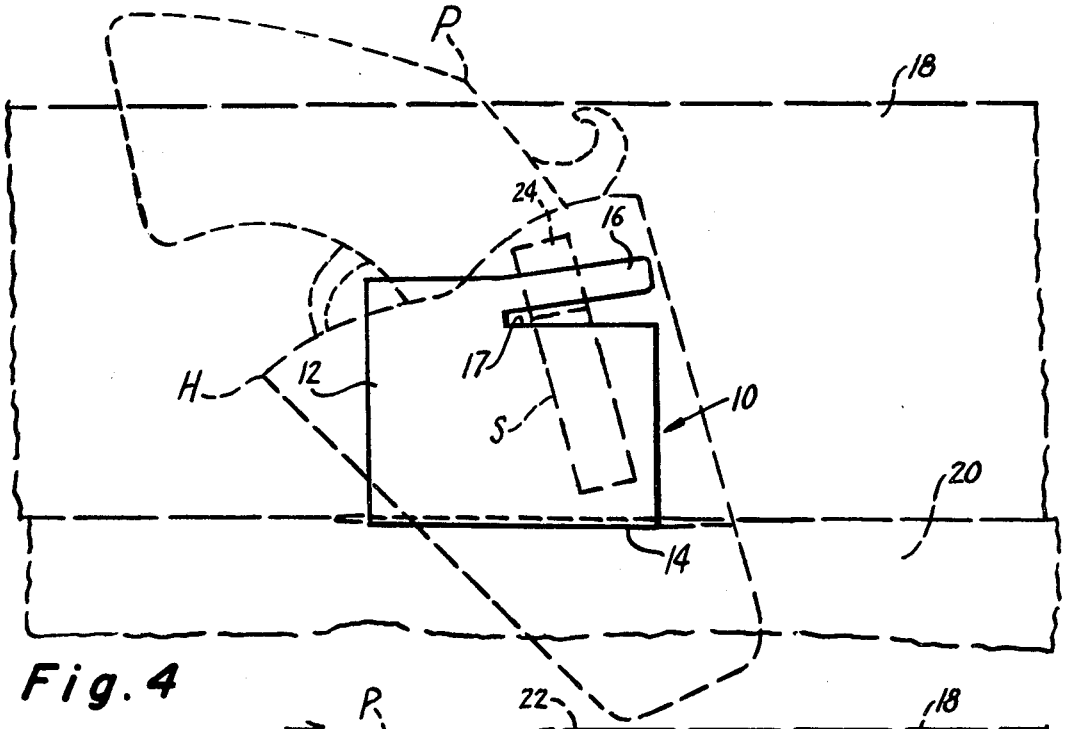
Fig. 4
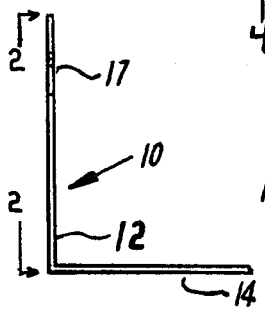
Fig. 1
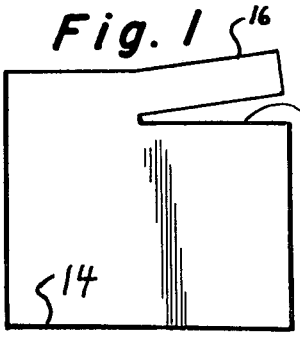
12 Fig. 2
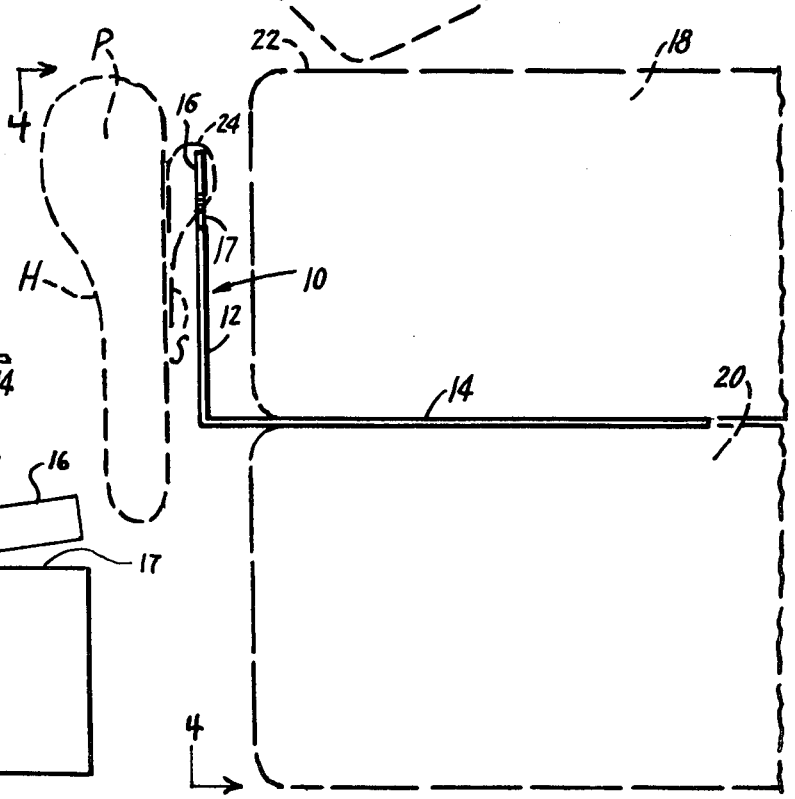
Fig. 3

HOLSTER HOLDER FOR BED

BACKGROUND OF THE INVENTION

The growing crime rate has caused more people to arm themselves and to keep a weapon near them when asleep. The usual places for keeping a pistol while sleeping is either on a night stand, under the bed, under a pillow, or in a holster suspended somewhere closeby. Should the occasion arise when the pistol is needed, it must be quickly retrieved or it is of no use, however, these usual places of storage do not provide for fast action. Consequently, it is better to leave the pistol where it is than to make some fruitless attempt to get it which could result in provoking an intruder.

The most reasonable place to have a pistol in terms of accessibility was under a pillow; however, the safety factor and discomfort of sleeping on a hard metal lump detracts from storing it there. The next reasonable place was on a night stand close by or under the bed. These places require a sudden movement to retrieve the pistol in a fast action, this is not alwasy possible depending on how awake a person is, their age, and how close an intruder is to the bed.

To overcome these disadvantages, the present invention places a pistol and holster where it can be reached without making obvious sudden movements which could attract the attention of an intruder. The holster bracket is inserted between the mattress and its box spring mattress at any place along the side of the bed where a person can without much effort, reach the pistol and not be detected.

SUMMARY OF THE INVENTION

The present invention relates to a holster bracket for a pistol kept near a bed where the bracket includes:

(a) an L-shaped bracket structure having a horizontal leg and a vertical leg;

(b) the length of the horizontal leg is longer than the length of the vertical leg where the horizontal leg is inserted between a mattress and a box spring mattress;

(c) the length of the vertical leg is less than the height of the mattress whereby the leg does not extend above the mattress; and (d) an angled element on the vertical leg for receiving the belt loop of the holster and to support the holster at an angle for easy removal of the pistol.

DESCRIPTION OF THE DRAWINGS

FIG. 1 is a front end view of a holster bracket of this invention.

FIG. 2 is a side end view taken along the line 2—2 of FIG. 1.

FIG. 3 is a front end view of a holster mounted on a holster bracket of this invention.

FIG. 4 is a side view taken along the line 3—3 of FIG. 3 showing a pistol and holster supported at an angle on the bracket.

DESCRIPTION OF THE INVENTION

Referring to the drawings and in particular, to FIG. 3, there is shown a holster bracket 10 which is made of a thin gauge metal thermoset plastic or wood having a thickness of about 1/16 of an inch. The bracket 10 is made of a single piece of metal bent to form an L-shape device with two legs: a horizontal leg 14 and a vertical leg 12. The horizontal leg is anywhere from one and one-half times to two times as long as the vertical leg. The purpose of the extra long horizontal leg 14 is to give the bracket a stationary base so that the bracket will not move. Vertical leg 12 is less than the height of a normal mattress which is about eight inches high such that a pistol and holster either slightly extends above the mattress as shown in FIGS. 3 and 4, or below the top of the mattress. The vertical leg has an angled element 16 for hanging the belt loop of a holster on and tilting the holster at a proper angle for quickly removing a pistol P.

The horizontal leg 14 is slid between the mattress 18 and its box spring 20. The mattress 18 is shown made with a sheet 22, therefore, the horizontal leg 14 is slid into place after the bed is made, but after the bed spread and covers have been pulled back for the night. In FIGS. 2 and 4, the vertical leg 12 is shown with angled element 16. In making the metal bracket, a cut or slit is made part way down from the top edge of the vertical leg 12. The length of the cut is about half way through the metal sheet. Depending on whether the person using the pistol is right handed or left handed, the cut is made from one side or the other of the vertical leg 12. Once the cut has been made, a wedge is forced in the cut bending the angled element 16 to the desired angle, which is between 5 to 10 degrees. Through tests, it was determined that the angled element was necessary to support the holster at an angle where it would not slip off the bracket when the pistol is removed. When a person is lying in bed, the natural way to remove a pistol is to pull the handle in an upward direction towards the head of the bed, by bending the angled element 16 from about 5–10 degrees, the holster hangs at a slight angle toward the head of the bed making it easier to remove a pistol. In FIG. 3, the holster H is shown with a belt loop 24 passing around the angled element 16, through cut 17.

A plastic bracket would have a molded angled element 16, and likewise, a wooden bracket would be cut with an angled element 16 the lower part of the belt loop is shown at S.

FIG. 1 shows an end view of the holster bracket 10 with horizontal leg 14 being about one and one-half times the length of vertical leg 12. The angled element 16 is shown with a gap between it and the side edge 26 of vertical leg 12.

In use, the holster bracket 10 is inserted between the made mattress 18 and box spring 20 after the top covers have been pulled back. The holster bracket 10 is inserted to leave a space of one inch or more between vertical leg 12 and the mattress. A holster H is hung on the angled element 16 of the vertical leg, tilting the holster H and pistol at a slight angle. Should it be necessary to use the pistol P, it is efficiently and quickly removed by a person lying in bed by pulling up and simultaneously toward the head of the bed.

It should be understood that while a person skilled in the art could redesign the present invention that the scope of the invention should be taken from an understanding of the drawings, the description and the claims taken together.

I claim:

1. A holster bracket for supporting a holster and pistol on the side of a bed for ready use comprising a one-piece L-shaped sheet metal bracket having a planar horizontal leg and a planar vertical leg, said horizontal leg being longer than said vertical leg and fitting under the mattress on said bed, an angular struck up holster belt loop receiving portion formed on the end portion of the vertical leg and in planar relationship with said leg, said struck up portion being at an angle between 5 and ten degrees to the main portion of said vertical leg, said angular struck up portion being below the level of said mattress, whereby when a holster is positioned on said struck up portion, the angle of the holster and pistol to the bed allows easy access to said pistol in an emergency.

* * * * *